United States Patent [19]

Godare

[11] Patent Number: 4,972,904

[45] Date of Patent: Nov. 27, 1990

[54] GEOTHERMAL WELL CHEMICAL INJECTION SYSTEM

[75] Inventor: William L. Godare, Houston, Tex.

[73] Assignee: Foster Oilfield Equipment Co., Houston, Tex.

[21] Appl. No.: 398,215

[22] Filed: Aug. 24, 1989

[51] Int. Cl.[5] ..... E21B 33/068; E21B 33/03

[52] U.S. Cl. ..... 166/77; 166/90; 166/97; 166/312; 166/85

[58] Field of Search ..... 166/85, 77, 88, 90, 166/69, 312, 50, 135, 84, 95; 261/76, 19, 38; 366/137

[56] References Cited

U.S. PATENT DOCUMENTS

| | | | |
|---|---|---|---|
| 1,791,874 | 2/1931 | Rodgers . | |
| 2,631,673 | 3/1953 | Halderson et al. | 166/312 |
| 2,694,450 | 11/1954 | Osbun . | |
| 2,696,261 | 12/1954 | Ennis . | |
| 2,854,079 | 9/1958 | Schnitter . | |
| 3,136,363 | 6/1964 | Yetman et al. . | |
| 3,139,932 | 7/1964 | Johnson . | |
| 3,414,056 | 12/1968 | Brown et al. | 166/135 |
| 3,545,541 | 12/1970 | DeVries . | |
| 4,091,867 | 5/1978 | Shannon et al. | 166/77 |
| 4,154,299 | 5/1979 | Winders . | |
| 4,327,804 | 5/1982 | Reed | 166/97 |
| 4,390,063 | 6/1983 | Wells | 166/90 |
| 4,512,410 | 4/1985 | Forester | 166/380 |
| 4,532,987 | 8/1985 | Reed | 166/88 |
| 4,586,825 | 5/1986 | Hayatdavoudi | 366/137 |
| 4,625,797 | 12/1986 | Tsutsumi et al. | 166/90 |
| 4,744,420 | 5/1988 | Patterson et al. . | |
| 4,765,410 | 8/1988 | Rogers et al. . | |
| 4,832,128 | 5/1989 | Light et al. | 166/377 |

*Primary Examiner*—Bruce M. Kisliuk
*Assistant Examiner*—Ezio DiSante
*Attorney, Agent, or Firm*—Edgar A. Zarins; Malcolm L. Sutherland

[57] ABSTRACT

A system for injecting chemicals into a geothermal well near the bottom of the well bore for optimum efficiency. The system includes a spool assembly with a master valve for control of the geothermal flow and a secondary outlet formed of an angle to permit the chemical injection chamber to be lowered into the well. The secondary outlet is attached to the main spool in such a way as to allow internal thermal expansion while permitting the chemical injection chamber to be fed by capillary tube to the bottom of the well bore. The chemical injection device includes an injection chamber through which the chemical is disbursed and a segmented sinker bar to provide the necessary weight to carry the chamber to the bottom of the well against the geothermal well flow. An annular seal assembly in the spool prevents leaking by being pressure energized by the geothermal production fluid. As a result, production can continue during the chemical injection process.

2 Claims, 2 Drawing Sheets

GEOTHERMAL WELL CHEMICAL INJECTION SYSTEM

BACKGROUND OF THE INVENTION

I. Field of the Invention

This invention relates to a system for injecting chemicals into a geothermal well and, in particular, to a spool and injection assembly which allows safe insertion of the injection assembly and internal casing expansion during insertion of the injection assembly through a secondary outlet independent of the master valve.

II. Description of the Prior Art

Geothermal wells produce steam from heated subsurface areas. The wells are drilled and completed utilizing oilwell drilling equipment although techniques differ for such wells including the use of larger well bores, well casings and surface wellhead valves and fittings. Steam from the geothermal wells flow from near the bottom of the well bore through the casing and surface valves in large enough volumes to power turbines for producing electricity. The distinctiveness of producing steam from geothermal wells brings operating complications specific to the geothermal industry that include corrosion problems and the build-up of scale on metal casings and surface valves. This corrosion and scaling faced by the geothermal industry limits the useful life and production capabilities of the geothermal well. In order to control this corrosion, various chemicals have been developed although they must be deployed near the bottom of the well.

The prior known method for entering the well with a chemical injection device capable of injecting chemicals near the bottom of the well involved opening of the master valve and inserting tubing from the surface to the bottom of the well. However, the open condition of the master valve for chemical injection creates a potentially dangerous situation since the master valve cannot be closed without destruction of the injecting tubing or damage to the master valve.

SUMMARY OF THE PRESENT INVENTION

The present invention overcomes the disadvantages of the prior known chemical injection systems by providing means for ensuring efficient insertion of the injector assembly while maintaining safe operation of the well.

The injector system of the present invention includes a surface spool which incorporates the master valve and a secondary port for insertion of the injector assembly. The secondary port is formed of an angle to provide proper insertion past the production casing received within the bottom of the spool. The secondary port includes a seal system to permit insertion of the injector and its associated capillary tubing. The spool assembly includes an annular seal assembly positioned at the lower end thereof to seal against the production casing which is matingly received within the spool. The seal assembly is pressure energized by the geothermal production fluid to prevent leaking between the spool and casing.

The chemical injection assembly used to inject the desired chemicals at the critical level includes an injection chamber weighted by a segmented sinker bar to carry the chamber to the bottom of the well. The weight of the sinker bar prevents the geothermal well flow from elevating the injection chamber while the segmented construction allows proper deployment. The injection chamber is fluidly connected to the surface by a capillary tube allowing the hydrostatic pressure at the bottom of the bore to disburse the chemicals from within the chamber.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
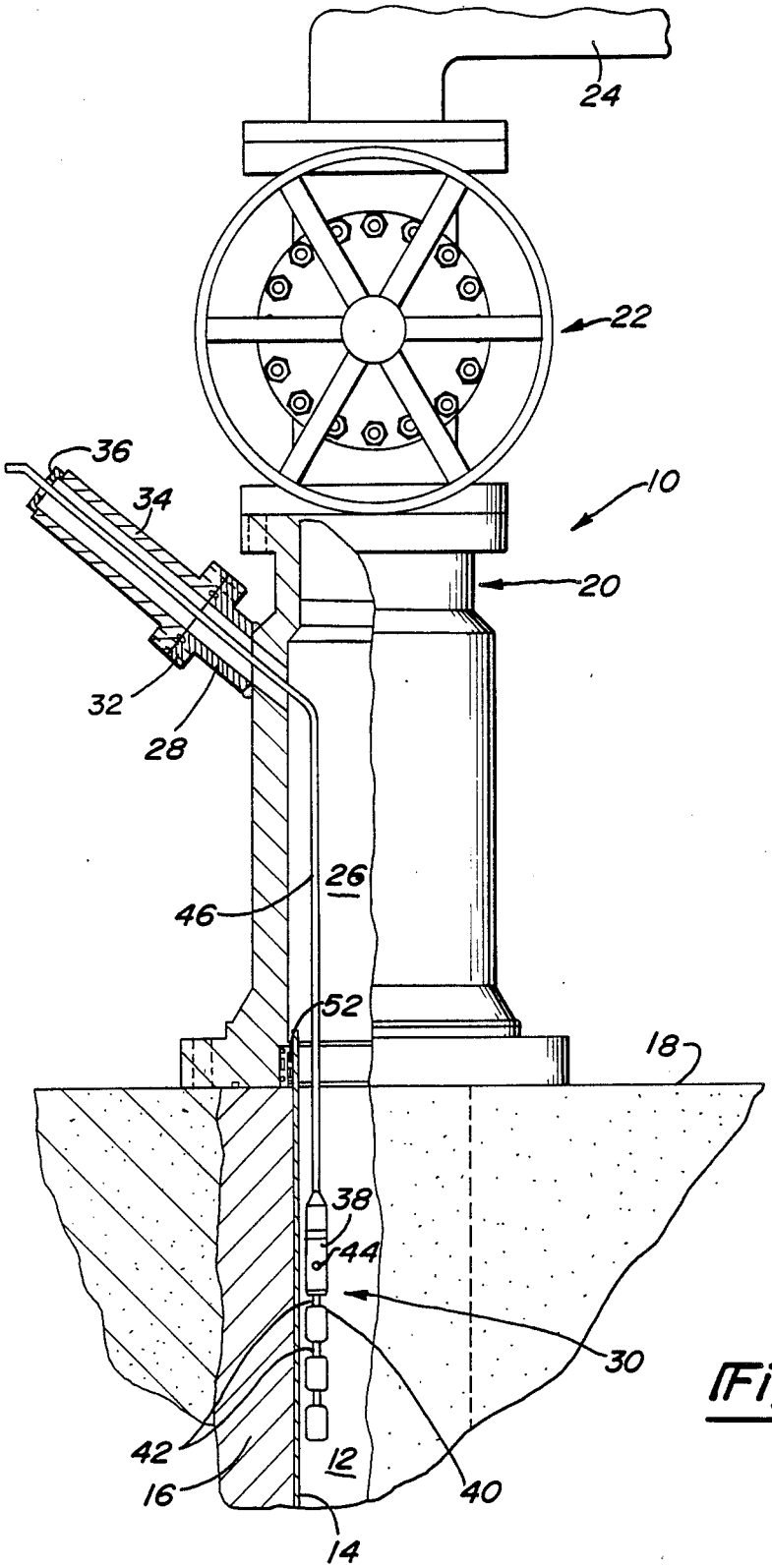
FIG. 1 is a perspective view partially in cross-section well injection system of the present invention.

Referring first to FIG. 1, there is shown a surface assembly of a production geothermal well 10 embodying the present invention. The geothermal well 10 generally comprises a well bore 12 within which is secured a production casing 14. The casing 14 is preferably cemented 16 within the well bore 12 using well known techniques and extends at least partially above ground level 18. In order to control the geothermal fluids flowing from the well 12, a surface spool assembly 20 is mounted to the upper end of the casing 14. The spool assembly 20 preferably includes a master valve 22 to close or open the well 10 thereby controlling flow to the delivery pipe 24.

Figure 2:
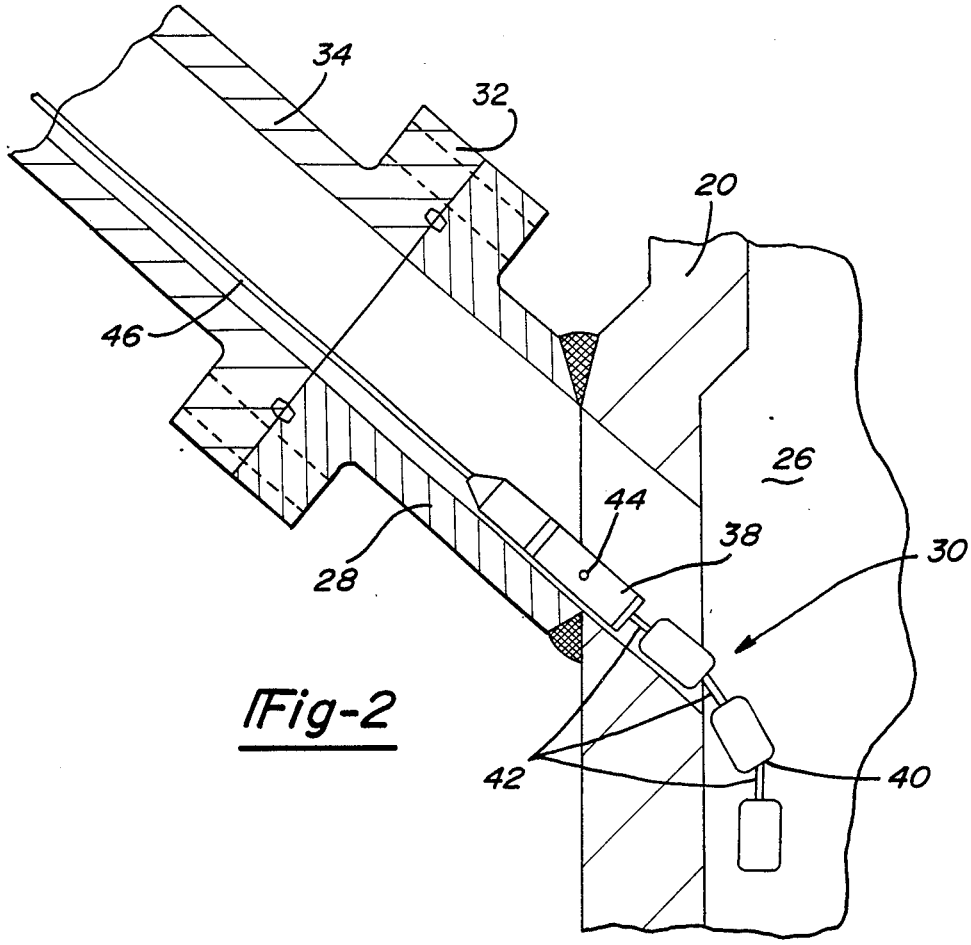
FIG. 2 is an enlarged perspective of the secondary outlet of the spool assembly with the injector disposed therein.
Figure 3:
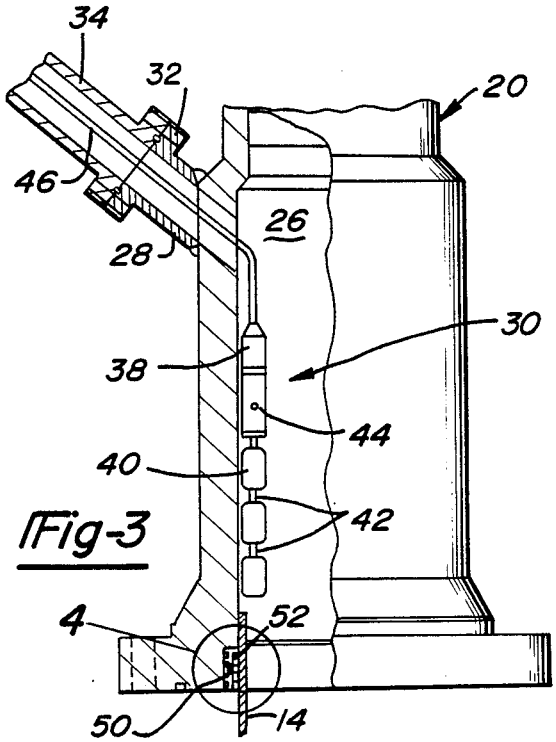
FIG. 3 is a partial perspective of the present invention with the injector assembly disposed therein.

Referring now to FIGS. 1 through 3, the preferred embodiment of the spool assembly 20 has an interior chamber 26 in communication with the well bore 12 and which receives the upper end of the production casing 14. Formed in a side wall of the spool assembly 20 is an injection port 28. The injection port 28 is formed at an angle to the spool assembly 20 to facilitate insertion of an injection assembly 30 into the geothermal well 10 as will be subsequently described in greater detail. The injection port 28 may include an annular flange 32 to allow mounting of a seal pipe 34 to the injection port 28 which allows the injection assembly 30 to be lowered through the well 10 while preventing loss of the geothermal fluids through the auxiliary port 28. A seal membrane 36 allows insertion while reducing fluid flow from the injection port 28.

The injection assembly 30 preferably comprises an injection chamber 38 and a segmented sinker bar 40 attached to the end of the injection chamber 38. The individual segments of the sinker bar 40 are connected to each other and to the lower end of the injection chamber 38 by wireline 42. The injection chamber 38 has at least one fluid port 44 through which the chemical fluid is dispersed within the well 10. The injection chamber 38 is connected to the surface and lowered into the well 10 by a capillary tube 46 which supplies the cleaning chemicals to the injection chamber 38 for dispersion through port 44. As best shown in FIG. 2, the segmented construction of the injection assembly 30 facilitates insertion into the spool chamber 26 without hanging up on the opposite wall. Sufficient weight on the sinker bar 40 must be provided in order to allow the injector assembly 30 to be lowered to the bottom of the well bore 12 against the flow within the geothermal well 10. In this manner, production can be maintained even as the injection chamber 38 is being lowered through the well 10. Furthermore, the angle of the injection port 28 is critical to allow proper entry of the injector assembly 30 into the production casing 14. Once the injection chamber 38 is positioned near the bottom of the well bore 12, the high hydrostatic pressure disperses the chemical fluid from the injection chamber 38 into the well 10.

Figure 4:
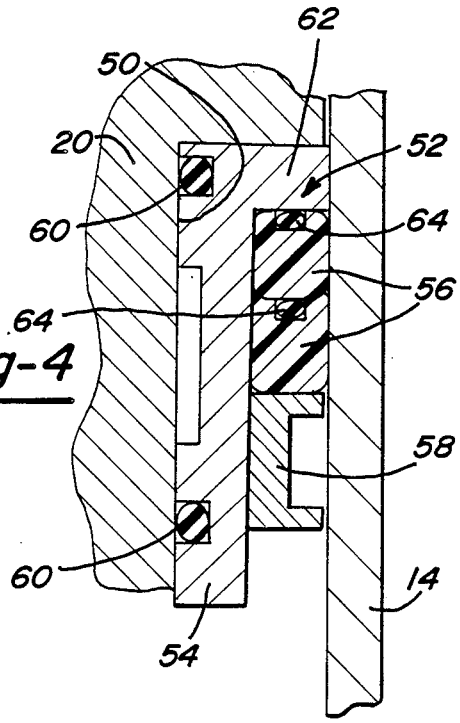
FIG. 4 is an enlarged perspective of the annular seal assembly from FIG. 3.

Referring now to FIGS. 1, 3 and 4, the lower end of the spool assembly 20 includes an annular seal seat 50 which receives an annular pressure-energized seal 52 adapted to seal between the spool 20 and the casing 14. The annular seal seat 50 allows the seal 52 to be recessed in such a way so as to allow the casing 14 to be received within the spool 20. A preferred embodiment of the annular pressure-energized seal 52 includes a seal base 54, at least one seal element 56, and a seal retainer 58. The seal elements 56 and retainer 58 are positionally retained by the base 54 but are movable therein to react to the fluid pressure between the casing 14 and the spool 20. The seal base 54 includes 0-rings 60 to seal against the seal seat 50 and a flange portion 62 to maintain spacing between the seat 50 and casing 14. The individual seal elements 56 have a generally U-shaped cross-sectional configuration (FIG. 4) with 0-rings 64. The seal elements 56 are positioned in a nested arrangement. The seal retainer 58 prevents the seal elements 56 from being pushed out of the base 54 under fluid pressure. Thus, the annular seal 52 prevents fluid leakage past the casing 14 and spool 20 in either direction while being pressure energized by the geothermal production fluid. Moreover, the mating relationship of the casing 14 within the spool 20 allows thermal expansion of the casing 14.

The foregoing detailed description has been given for clearness of understanding only and no unnecessary limitations should be understood therefrom a some modifications will be obvious to those skilled in the art without departing from the scope and spirit of the appended claims.

I claim:

1. A system for injecting a chemical fluid into a producing geothermal well, the geothermal well having production casing disposed therein, said system comprising:

a surface spool assembly with an interior chamber sealingly receiving an upper end of the production casing, said spool assembly having a master valve mounted on an upper portion thereof for controlling fluid flow through said interior chamber;

said spool assembly including an injection port located below said master valve and above said upper end of said production casing; said injection port being formed in a side wall of said spool assembly at a substantial downward angle to the vertical axis of said interior chamber to provide a fluid communication with said interior chamber;

flexible seal means closing the outward end of said injection port but permitting the passage therethrough of tubular objects;

an injector assembly having external dimensions permitting the assembly to be lowerable through said flexible seal means, said injection port and said interior chamber into the well casing; said injector assembly including a tubular injector chamber and a small diameter flexible fluid tube communicating with said injector chamber for lowering said injector assembly into the well, whereby chemical fluid may be supplied from the surface through said flexible tube to said injector chamber for injection into the geothermal well;

segmented weight means secured to said injection assembly; and said segemented weight means being laterally flexible to permit insertion through said injection port; said interior chamber and said production casing, whereby well production may be maintained during insertion and utilization of said injector assembly.

2. The apparatus of claim 1 wherein said flexible seal means comprises a membrane.

* * * * *